US010662945B2

(12) United States Patent
Tsubai et al.

(10) Patent No.: US 10,662,945 B2
(45) Date of Patent: May 26, 2020

(54) SCROLL COMPRESSOR INCLUDING VALVE HAVING MULTIPLE ARMS

(71) Applicant: KABUSHIKI KAISHA TOYOTA JIDOSHOKKI, Kariya-shi, Aichi-ken (JP)

(72) Inventors: Shinji Tsubai, Aichi-ken (JP); Yoshikazu Fukutani, Aichi-ken (JP); Yoshihiro Fukaya, Aichi-ken (JP)

(73) Assignee: KABUSHIKI KAISHA TOYOTA JIDOSHOKKI, Kariya-shi, Aichi-ken (JP)

( * ) Notice: Subject to any disclaimer, the term of this patent is extended or adjusted under 35 U.S.C. 154(b) by 309 days.

(21) Appl. No.: 15/715,844

(22) Filed: Sep. 26, 2017

(65) Prior Publication Data

US 2018/0087508 A1 Mar. 29, 2018

(30) Foreign Application Priority Data

Sep. 29, 2016 (JP) ..... 2016-192035

(51) Int. Cl.

| | |
|---|---|
| ***F04C 18/02*** | (2006.01) |
| ***F04C 29/12*** | (2006.01) |
| ***F04C 23/00*** | (2006.01) |

(52) U.S. Cl.

CPC ..... *F04C 18/0261* (2013.01); *F04C 18/0215* (2013.01); *F04C 29/12* (2013.01); *F04C 29/128* (2013.01); *F04C 23/008* (2013.01)

(58) Field of Classification Search

CPC ... F04C 18/0215; F04C 18/0261; F04C 29/12
USPC ..... 418/15, 55.2, 55.1
See application file for complete search history.

(56) References Cited

U.S. PATENT DOCUMENTS 5,855,475 A * 1/1999 Fujio ..... F04C 18/0215 418/15

FOREIGN PATENT DOCUMENTS

JP 2013-256878 A 12/2013

* cited by examiner

*Primary Examiner* — Patrick Hamo
*Assistant Examiner* — Paul W Thiede
(74) *Attorney, Agent, or Firm* — Sughrue Mion, PLLC

(57) ABSTRACT

A scroll type compressor includes a fixed scroll including a base plate and a scroll wall. The base plate has a main discharge port, a sub-discharge port, an injection port and a valve. The valve includes first and second arms and a valve base including an attaching portion. Each of the first and the second arms includes proximal and distal ends. The first and the second arms extend from the proximal ends on the valve base to the main discharge port and the sub-discharge port, respectively. The first and the second arms extend so as to come closer to each other at the distal ends thereof than at the proximal ends thereof. The injection port is disposed in an injection arrangement area that is an area located between the first and the second arms and expands larger on the proximal ends side than on the distal ends side.

6 Claims, 4 Drawing Sheets

SCROLL COMPRESSOR INCLUDING VALVE HAVING MULTIPLE ARMS

BACKGROUND OF THE INVENTION

The present invention relates to a scroll type compressor.

A scroll type compressor generally includes a fixed scroll and a movable scroll. Each scroll includes a base plate and a scroll wall extending from the base plate. The movable scroll cooperates with the fixed scroll to define a compression region and is configured to make an orbital motion to compress fluid in the compression region. Japanese Unexamined Patent Application Publication No. 2013-256878 discloses a scroll type compressor having a main discharge port, a sub-discharge port and an injection port. The sub-discharge port and the injection port of this compressor are disposed radially outward of the main discharge port.

The scroll type compressor may include a valve on the base plate of the fixed scroll to prevent fluid from flowing back to the compression region through the main and sub-discharge ports. The valve needs to cover both of the main and the sub-discharge ports without covering the injection port. However, using a plurality of valves to cover the main discharge port and the sub-discharge port separately without covering the injection part may cause an increase of the number of parts in the compressor.

The present invention, which has been made in light of the above-described problem, is directed to providing a scroll type compressor in which both of main and sub-discharge ports are covered by a single valve with an injection port uncovered.

SUMMARY OF THE INVENTION

In accordance with one aspect of the present invention, there is provided a scroll type compressor including a fixed scroll and a movable scroll. Each of the fixed and the movable scrolls includes a base plate and a scroll wall. The base plate of the fixed scroll includes on opposite sides thereof first and second surfaces. The scroll wall of the fixed scroll extends from the first surface of the base plate of the fixed scroll. The base plate of the movable scroll faces the base plate of the fixed scroll. The scroll wall of the movable scroll extends from the base plate of the movable scroll toward the base plate of the fixed scroll to mesh with the scroll wall of the fixed scroll. The movable scroll cooperates with the fixed scroll to define a compression region and is configured to make an orbital motion to compress fluid in the compression region. The base plate of the fixed scroll has therethrough a main discharge port, a sub-discharge port and an injection port that are configured to communicate with the compression region. The sub-discharge port is disposed radially outward of the main discharge port with respect to a center of the scroll wall of the fixed scroll. The injection port is disposed radially outward of the main discharge port with respect to the center of the scroll wall of the fixed scroll to supply fluid to the compression region. The base plate of the fixed scroll further has on the second surface thereof a valve that covers the main discharge port and the sub-discharge port. The valve includes a valve base, a first arm, and a second arm. The valve base is disposed radially outward of the main discharge port, the sub-discharge port, and the injection port with respect to the center of the scroll wall of the fixed scroll and extending circumferentially with respect to the center of the scroll wall of the fixed scroll, and includes an attaching portion to fix the valve to the second surface of the base plate of the fixed scroll. Each of the first and the second arms includes proximal and distal ends. The first and the second arms extend from the proximal ends that are disposed on the valve base to the main discharge port and the sub-discharge port, respectively. The first arm and the second arm extend so as to come closer to each other at the distal end of the first arm and the distal end of the second arm than at the proximal end of the first arm and the proximal end of the second arm. The injection port is disposed in an injection arrangement area on the second surface of the base plate of the fixed scroll. The injection arrangement area is an area located between the first arm and the second arm and expands larger on the proximal ends side of the first and the second arms than on the distal ends side of the first and the second arms.

Other aspects and advantages of the invention will become apparent from the following description, taken in conjunction with the accompanying drawings, illustrating by way of example the principles of the invention.

DETAILED DESCRIPTION OF THE EMBODIMENTS

Figure 2:
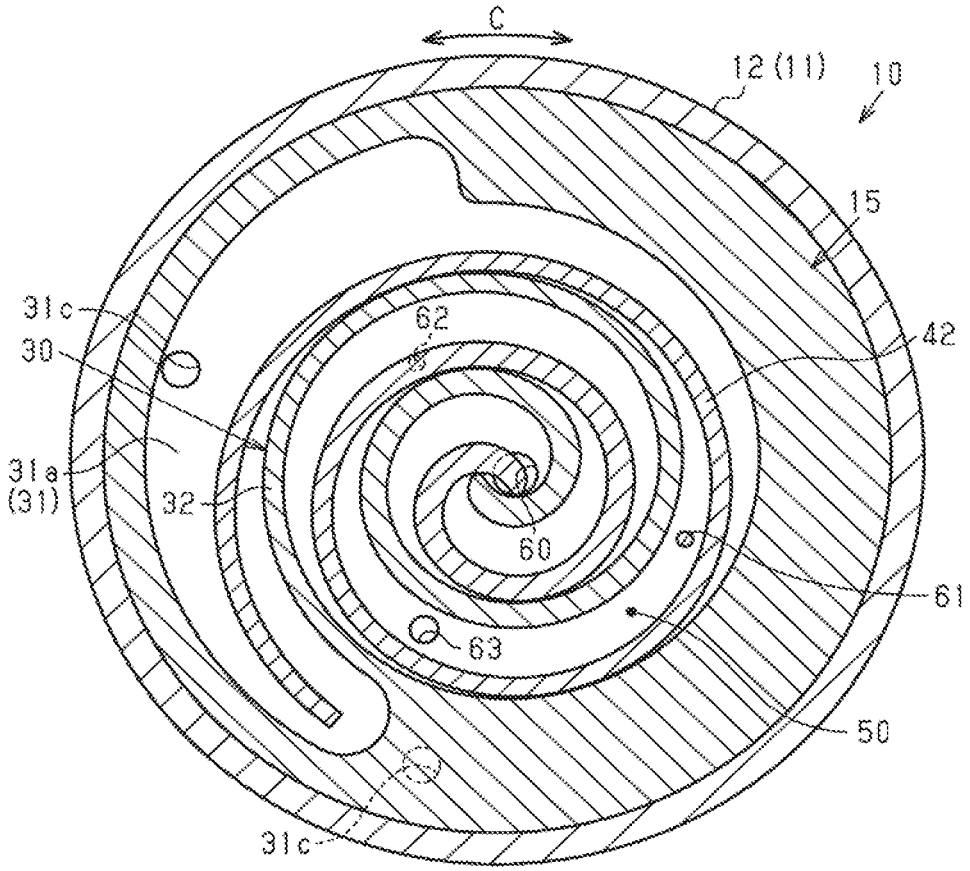
FIG. 2 is a vertical sectional view showing a compression part of the scroll type compressor of FIG. 1.
Figure 3:
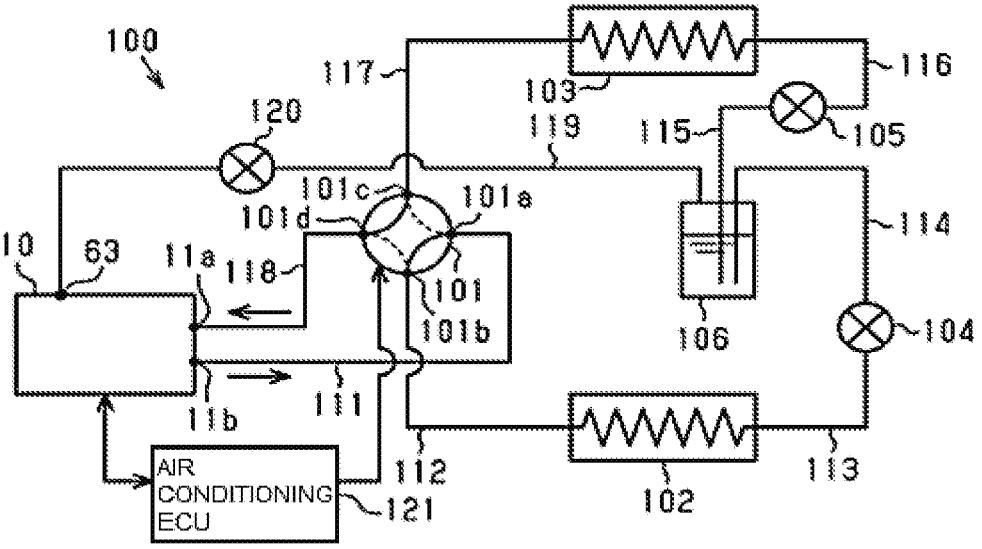
FIG. 3 is a schematic diagram showing a vehicle air conditioner in which the compressor of FIG. 1 is incorporated.
Figure 4:
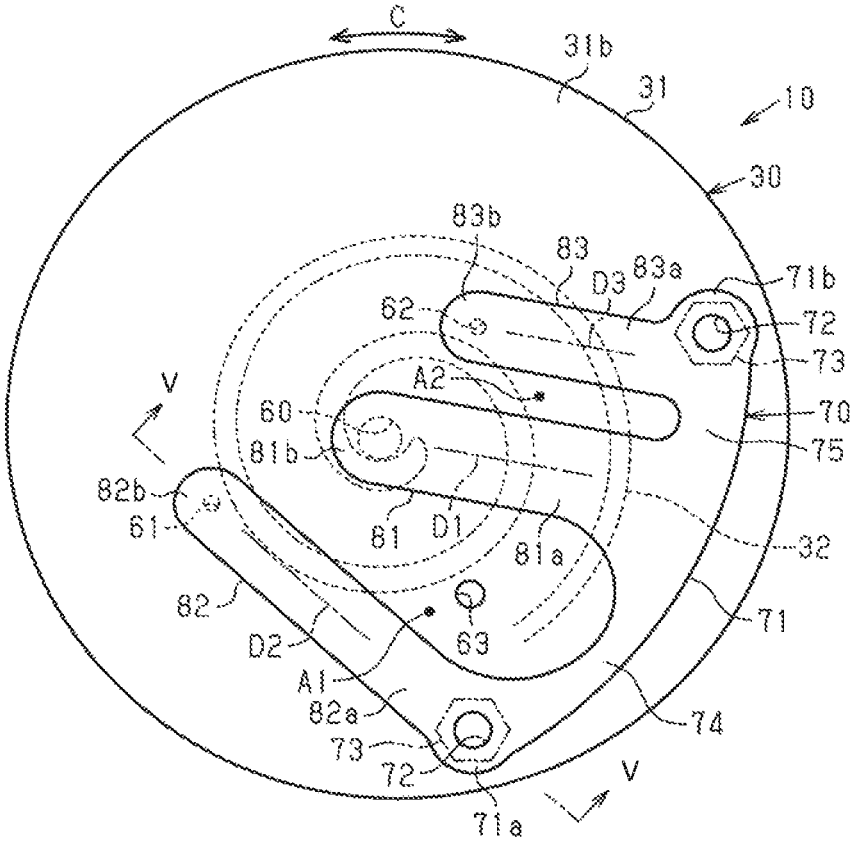
FIG. 4 is a front view showing a second surface of a base plate of a fixed scroll to which a valve is fixed.
Figure 5:
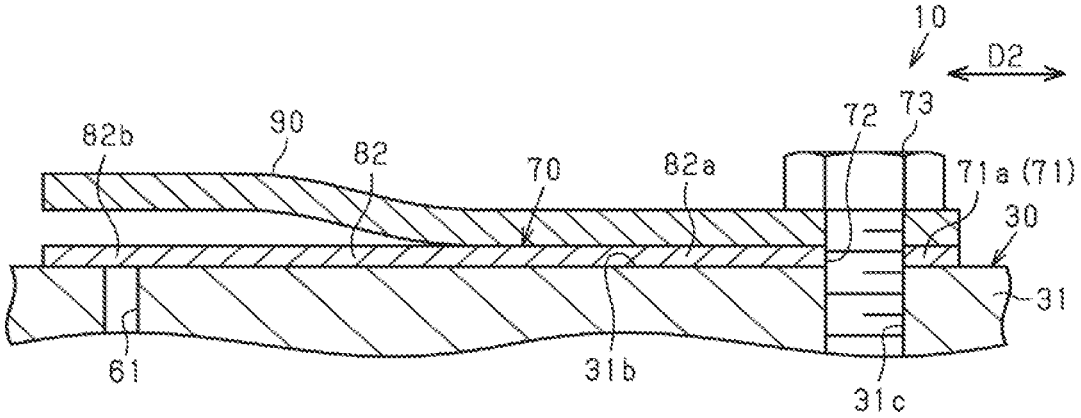
FIG. 5 is a sectional view taken along the line V-V of FIG. 4, showing the second surface to which the valve of FIG. 4 and a retainer are fixed.

The following will describe an embodiment of the present invention with reference to the accompanying FIGS. 1 to 5. FIG. 4 shows a valve 70 without a retainer 90 for convenience in drawing, but FIG. 5 shows the valve 70 with the retainer 90.

Figure 1:
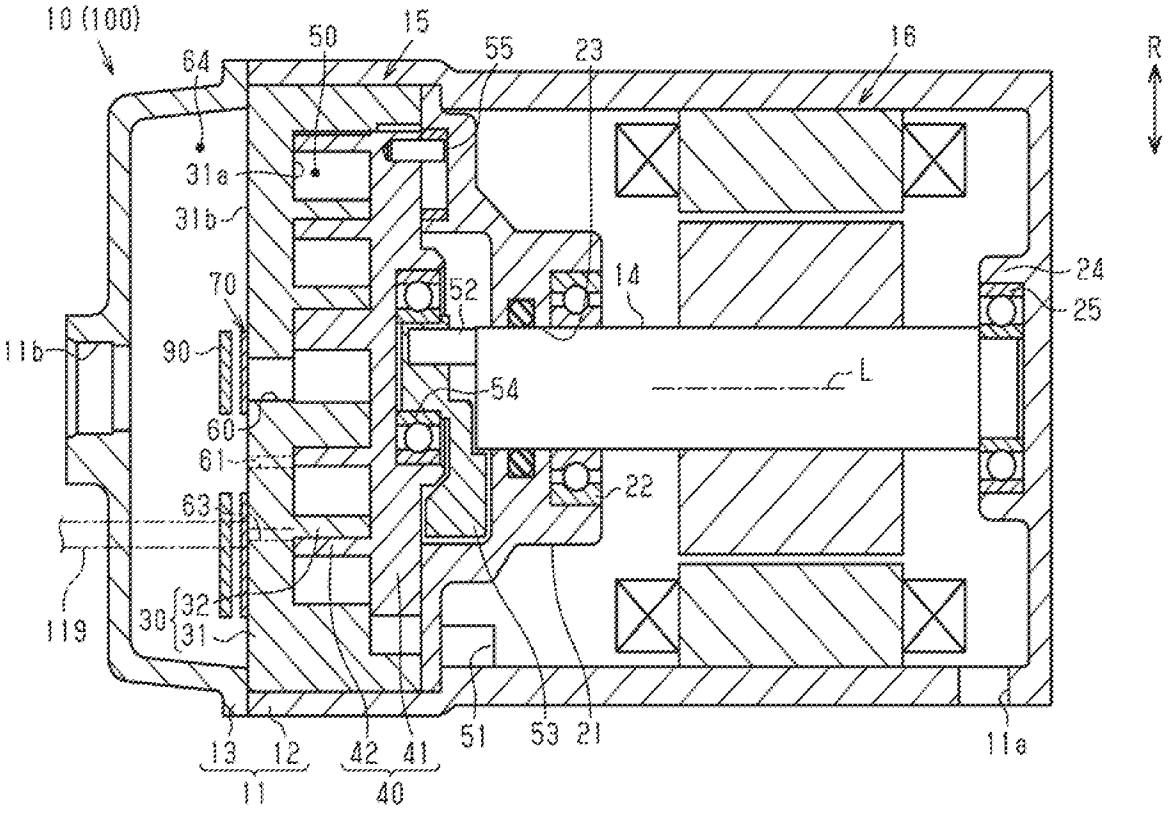
FIG. 1 is a schematic longitudinal sectional view of a scroll type compressor according to an embodiment of the present invention.

Referring to FIG. 1, there is shown a scroll type compressor 10, which includes a housing assembly 11 having an inlet 11*a* for suction of fluid and an outlet 11*b* for discharge of fluid. The housing assembly 11 is formed in an approximate cylindrical shape by two housing parts 12, 13 formed in a bottomed cylindrical shape as a whole. The first housing part 12 and the second housing part 13 are connected to each other at the openings thereof. The inlet 11*a* is formed through the side wall of the first housing part 12 and the outlet 11*b* through the bottom wall of the second housing part 13.

The scroll type compressor 10 further includes a rotary shaft 14, a compression part 15 and an electric motor 16 in the housing assembly 11. The compression part 15 compresses fluid suctioned through the inlet 11*a* and discharges the compressed fluid through the outlet 11*b*. The electric motor 16 drives the compression part 15. In the housing assembly 11, the electric motor 16 and the compression part 15 are disposed on the inlet 11*a* side and on the outlet 11*b* side, respectively.

The rotary shaft 14 is rotatably accommodated in the housing assembly 11. Specifically, the rotary shaft 14 is supported by a shaft support member 21, which is fixed in the housing assembly 11. The shaft support member 21 is, for example, located between the compression part 15 and the electric motor 16 in the housing assembly 11. The shaft support member 21 has therein an insertion hole 23. The insertion hole 23 has therein a first bearing 22 and receives therethrough the rotary shaft 14. The shaft support member 21 and the bottom wall of the first housing part 12 face each other through the electric motor 16. The first housing part 12 has on the bottom wall thereof a cylindrical boss 24. The cylindrical boss 24 includes a second bearing 25. The rotary shaft 14 is rotatably supported by the first and the second bearings 22, 25.

The compression part 15 of the scroll type compressor 10 includes a fixed scroll 30 and a movable scroll 40. The fixed scroll 30 is fixed to the housing assembly 11 and includes a disc-shaped base plate 31 and a scroll wall 32. The base plate 31 is disposed coaxially with the rotary shaft 14 and has on the opposite sides thereof first and second surfaces 31*a*, 31*b*. The scroll wall 32 extends from the first surface 31*a* of the base plate 31. The movable scroll 40 includes a disc-shaped base plate 41 and a scroll wall 42. The base plate 41 faces the base plate 31 of the fixed scroll 30, and the scroll wall 42 extends from the base plate 41 toward the base plate 31 of the fixed scroll 30. The base plates 31 and 41 face each other in the thickness direction thereof and in the axial direction of the rotary shaft 14. The thickness direction of the base plates 31 and 41 corresponds to the axial direction of the rotary shaft 14.

As shown in FIGS. 1 and 2, the scroll wall 32 of the fixed scroll 30 and the scroll wall 42 of the movable scroll 40 mesh with each other. The front end face of the scroll wall 32 of the fixed scroll 30 contacts the base plate 41 of the movable scroll 40, while the front end face of the scroll wall 42 of the movable scroll 40 contacts the first surface 31*a* of the base plate 31 of the fixed scroll 30. The fixed scroll 30 and the movable scroll 40 cooperate to define a compression region 50. As shown in FIG. 1, the housing assembly 11 has a suction passage 51 to supply the suctioned fluid into the compression region 50.

Directional notations appearing in the following description and the drawings are associated with the disc-shaped base plate 31 of the fixed scroll 30. Namely, the radial direction R represents the radial direction of the base plate 31, and the circumferential direction C the circumferential direction of the base plate 31. The radial direction R and the circumferential direction C also correspond to the directions of the rotary shaft 14 and the scroll wall 32.

The movable scroll 40 is configured to make an orbital motion with the rotation of the rotary shaft 14. Specifically, the rotary shaft 14 partially protrudes through the insertion hole 23 of the shaft support member 21 toward the compression part 15, and has an eccentric pin 52 on one end face of the rotary shaft 14 on the compression part 15 side. The eccentric pin 52 is located eccentrically to the axis line L of the rotary shaft 14 and has a bush 53. The bush 53 and the base plate 41 of the movable scroll 40 are connected through a bearing 54.

The scroll type compressor 10 according to this embodiment further includes a plurality of anti-rotation parts 55. The anti-rotation parts 55 restrict the rotation of the movable scroll 40 but allow the movable scroll 40 to make an orbital motion.

According to this embodiment of the present invention, the movable scroll 40 orbits the axis line of the fixed scroll 30 (namely, the axis line L of the rotary shaft 14) with the rotation of the rotary shaft 14. The orbital motion of the movable scroll 40 operates to reduce the volume of the compression region 50, so that fluid flowed through the suction passage 51 is compressed in the compression region 50.

As shown in FIGS. 2 and 4, the base plate 31 of the fixed scroll 30 has therethrough a main discharge port 60, first and second sub-discharge ports 61, 62 and an injection port 63. The main discharge port 60, the first and the second sub-discharge ports 61, 62 and the injection port 63 are configured to communicate with the compression region 50, but not always communicate with the compression region 50 continuously. The main discharge port 60, the first and the second sub-discharge ports 61, 62, and the injection port 63 may communicate with the compression region 50 only during a limited period of time in one revolution of the movable scroll 40.

The main discharge port 60 is formed inward of the outer periphery of the scroll wall 32, specifically, at the center of the fixed scroll 30 in the view from the thickness direction of the base plate 31. Because fluid flows within the compression region 50 from the outer periphery side of the scroll walls 32, 42 toward the center of the scroll walls 32, 42, the most compressed fluid is discharged through the main discharge port 60 that is located at the most downstream position in the compression region 50.

The first and the second sub-discharge ports 61, 62 operate to restrain excessive compression of fluid. The first and the second sub-discharge ports 61, 62 are disposed outward of the main discharge port 60 in the radial direction R, specifically, upstream of the main discharge port 60 in the compression region 50, so that fluid under compression is discharged from the compression region 50 through the first and the second sub-discharge ports 61, 62.

According to this embodiment, the first and the second sub-discharge ports 61, 62 are disposed away from each other in the circumferential direction C and the radial direction R, and the second sub-discharge port 62 is disposed across the main discharge port 60 from the first sub-discharge port 61.

The first and the second sub-discharge ports 61, 62 are smaller than the main discharge port 60, however, the first and the second sub-discharge ports 61, 62 may be formed in any size. For example, the first and the second sub-discharge ports 61, 62 may be formed in the same size as the main discharge port 60.

As shown in FIG. 1, the housing assembly 11 has therein a discharge chamber 64. The discharge chamber 64 is configured to communicate with the compression region 50 through the main discharge port 60 and the first and the second sub-discharge ports 61, 62. The discharge chamber 64 is a space defined by the second housing part 13 having the outlet 11*b* and the base plate 31 of the fixed scroll 30. Fluid flows into the discharge chamber 64 through the main discharge port 60 and the first and the second sub-discharge ports 61, 62, and then flows out through the outlet 11*b*.

The injection port 63 is used to supply fluid to the compression region 50. The injection port 63 is disposed outward of the main discharge port 60 in the radial direction R and hence upstream of the main discharge port 60 relative to the compression region 50. The injection port 63 is connected to an injection pipe 119. The injection pipe 119 will be described later. Only one injection port 63 is provided in this embodiment for the sake of description, but two or more injection ports may be provided as necessary.

The electric motor 16 rotates the rotary shaft 14 to cause the movable scroll 40 to make an orbital motion. The scroll type compressor 10 may include a drive circuit that is configured to drive the electric motor 16.

The scroll type compressor 10 according to this embodiment is mounted to a vehicle and used for a vehicle air conditioner 100. That is, fluid compressed by the scroll type compressor 10 is refrigerant in this embodiment.

As shown in FIG. 3, the vehicle air conditioner 100 includes a switching valve 101, first and second heat exchangers 102, 103, first and second expansion valves 104, 105, and a gas-liquid separator 106.

The switching valve 101 has first to fourth ports 101*a* to 101*d* to switch between the first condition and the second condition. In the first condition, the first port 101*a* and the second port 101*b* are made to communicate with one another, and the third port 101*c* and the fourth port 101*d* are made to communicate with one another. In the second condition, the first port 101*a* and the third port 101*c* are made to communicate with one another and the second port 101*b* and the fourth port 101*d* are made to communicate with one another.

The vehicle air conditioner 100 further includes first to eighth pipes 111 to 118. The first pipe 111 connects the outlet 11*b* of the scroll type compressor 10 with the first port 101*a* of the switching valve 101. The second pipe 112 connects the second port 101*b* of the switching valve 101 with the first heat exchanger 102. The third pipe 113 connects the first heat exchanger 102 with the first expansion valve 104. The fourth pipe 114 connects the first expansion valve 104 with the gas-liquid separator 106. The fifth pipe 115 connects the gas-liquid separator 106 and the second expansion valve 105. The sixth pipe 116 connects the second expansion valve 105 with the second heat exchanger 103. The seventh pipe 117 connects the second heat exchanger 103 with the third port 101*c* of the switching valve 101. The eighth pipe 118 connects the fourth port 101*d* of the switching valve 101 with the inlet 11*a* of the scroll type compressor 10.

The injection pipe 119 connects the injection port 63 and the gas-liquid separator 106 and has a check valve 120. The check valve 120 may be mounted to the scroll type compressor 10.

According to this embodiment, the vehicle air conditioner 100 is configured to provide both air cooling and heating. Specifically, the vehicle air conditioner 100 includes an air conditioning ECU 121 to totally control the vehicle air conditioner 100 including the switching valve 101. For example, the air conditioning ECU 121 sets the switching valve 101 in the first condition for cooling the air in a vehicle. In the first condition, refrigerant discharged from the outlet 11*b* of the scroll type compressor 10 flows into the first heat exchanger 102 to be condensed by the heat exchange with outside air. The condensed refrigerant is decompressed by the first expansion valve 104 and flows into the gas-liquid separator 106 to be separated into a gaseous refrigerant and a liquid refrigerant. The liquid refrigerant is decompressed by the second expansion valve 105 and flows into the second heat exchanger 103. Then, the liquid refrigerant is evaporated by the heat exchange with the air in the vehicle compartment through the second heat exchanger 103, so that the air in the vehicle is cooled down. The evaporated refrigerant flows from the second heat exchanger 103 to the inlet 11*a* of the scroll type compressor 10. The check valve 120 is kept closed during cooling.

For heating the air in a vehicle, the air conditioning ECU 121 sets the switching valve 101 in the second condition. In the second condition, the refrigerant discharged from the outlet 11*b* of the scroll type compressor 10 flows into the second heat exchanger 103 to be condensed by the heat exchange with the air in the vehicle, so that the air in the vehicle is heated. The condensed refrigerant is decompressed by the second expansion valve 105 and flows into the gas-liquid separator 106 to be separated into a gaseous refrigerant and a liquid refrigerant. The liquid refrigerant is decompressed by the first expansion valve 104 and flows into the first heat exchanger 102 to be evaporated by the heat exchange with the outside air. Then, the evaporated refrigerant flows to the inlet 11*a* of the scroll type compressor 10.

The check valve 120 is kept open during heating, so that the gaseous refrigerant separated by the gas-liquid separator 106 flows from the gas-liquid separator 106 to the compression region 50 through the injection pipe 119 and the injection port 63. Accordingly, the volume of the refrigerant that flows into the compression region 50 is increased.

The gaseous refrigerant separated by the gas-liquid separator 106, which is the refrigerant introduced into the compression region 50 through the injection port 63, has a pressure higher than that of the refrigerant suctioned through the inlet 11*a* of the scroll type compressor 10, but lower than that of the refrigerant discharged from the outlet 11*b*. That is, the injection port 63 is a port to supply or introduce fluid at intermediate pressure, which is fluid having a pressure higher than that of the suctioned fluid but lower than the discharged fluid, to the compression region 50.

As shown in FIG. 4, the scroll type compressor 10 includes a valve 70 to cover the main discharge port 60 and the first and the second sub-discharge ports 61, 62. The valve 70 is disposed on the second surface 31*b* of the base plate 31 of the fixed scroll 30. The second surface 31*b* is the opposite surface to the first surface 31*a* of the base plate 31 of the fixed scroll 30. The valve 70 is made of a thin elastically deformable plate, and the thickness direction of the valve 70 corresponds to that of the base plate 31.

The valve 70 includes a valve base 71 and first to third arms 81 to 83. The valve base 71 is disposed radially outward of the main discharge, the first and the second sub-discharge, and the injection ports 60 to 63 and axially outward of the outer periphery of the scroll wall 32 of the fixed scroll 30. The valve base 71 extends in a circumferential direction C.

The valve base 71 of the valve 70 has through holes 72. The through holes 72 serve as an attaching portion for fixing the valve 70 to the second surface 31*b* of the base plate 31. The through holes 72 are disposed axially outward of the outer periphery of the scroll wall 32. According to this embodiment of the present invention, the through holes 72 are respectively disposed at first and second ends 71*a*, 71*b* of the valve base 71.

As shown in FIGS. 2 and 5, the base plate 31 of the fixed scroll 30 has therein bolt holes 31*c*. The bolt holes 31*c* are configured to communicate with the through holes 72 of the valve base 71, respectively. The bolt holes 31*c* are disposed outward of the outer periphery of the scroll wall 32 of the fixed scroll 30 to correspond to the positions of the through holes 72 that are disposed outward of the outer periphery of the scroll wall 32 of the fixed scroll 30 in the view from the thickness direction of the base plate 31 of the fixed scroll 30. The bolt holes 31*c* are disposed radially outward of the compression region 50.

The scroll type compressor 10 includes bolts 73. The bolts 73 are inserted through the through holes 72 and screwed into the bolt holes 31*c*, respectively. The bolts 73 fix the valve 70 to the second surface 31*b* of the base plate 31 of the fixed scroll 30.

As shown in FIG. 4, the first to the third arms 81 to 83 extend from the valve base 71 to the main discharge and the first and the second sub-discharge ports 60 to 62, respectively. The first to the third arms 81 to 83 are spaced in the circumferential direction C, and the first arm 81 is disposed between the second arm 82 and the third arm 83.

The first arm 81 extends from a predetermined position between opposite ends 71*a* and 71*b* of the valve base 71 and includes a first proximal end 81*a* on the valve base 71 and a first distal end 81*b* covering the main discharge port 60.

The second arm 82 extends from the first end 71*a* of the valve base 71 to the first sub-discharge port 61 and includes a second proximal end 82*a* on the first end 71*a* of the valve base 71 and a second distal end 82*b* covering the first sub-discharge port 61. One of the through holes 72 is formed through the first end 71*a* of the valve base 71 and located closer to the second arm 82 than to the first arm 81.

The third arm 83 extends from the second end 71*b* of the valve base 71 to the second sub-discharge port 62 and includes a third proximal end 83*a* on the second end 71*b* of the valve base 71 and a third distal end 83*b* covering the second sub-discharge port 62.

The first arm 81 and the second arm 82 extend from the valve base 71 so as to come closer to each other at the first distal end 81*b* and the second distal end 82*b* than at the first proximal end 81*a* and the second proximal end 82*a*. The second arm 82 extends longer than the first arm 81. Extending directions of the first arm 81 and the second arm 82 are respectively indicated by the first extending direction D1 and the second extending direction D2 in the following description and the drawings.

The third arm 83 is disposed across the first arm 81 from the second arm 82. The first arm 81 and the third arm 83 extend in the same direction. Specifically, the first extending direction D1 and a third extending direction D3 of the third arm 83 are parallel to each other. The third arm 83 extends shorter than the first arm 81.

As shown in FIG. 4, the injection port 63 is disposed in an injection arrangement area A1 formed on the second surface 31*b* of the base plate 31 of the fixed scroll 30. The injection arrangement area A1 is a large area between the first arm 81 and the second arm 82 on the second surface 31*b* and closer to the first and the second proximal ends 81*a*, 82*a* than to the first and the second distal ends 81*b*, 82*b*. The injection arrangement area A1 is defined by the first arm 81, the second arm 82, and a first base portion 74. The first base portion 74 is a portion of the valve base 71 between the first arm 81 and the second arm 82 and extends longer than a second base portion 75, which is a portion of the valve base 71 between the first arm 81 and the third arm 83, in the circumferential direction C.

The first arm 81 and the second arm 82 extend from the first and the second proximal ends 81*a*, 82*a* on the valve base 71 so as to come closer to each other at the first distal end 81*b* and the second distal end 82*b* than at the first proximal end 81*a* and the second proximal end 82*a*. Accordingly, the distance between the first arm 81 and the second arm 82 decreases with the extension of the first arm 81 and the second arm 82 from the first and the second proximal ends 81*a*, 82*b* toward the first and the second distal ends 81*b*, 82*b*, and the distance between the first arm 81 and the second arm 82 reaches its minimum distance near the first and the second distal ends 81*b* 82*b*. The injection arrangement area A1 is an area that is located on the first and the second proximal ends 81*a*, 82*a* side of the aforementioned minimum distance between the first arm 81 and the second arm 82 and has a longer distance between the first arm 81 and the second arm 82 than the aforementioned minimum distance between the first arm 81 and the second arm 82.

The first base portion 74 is a portion of the valve base 71 and disposed between the first proximal end 81*a* and the second proximal end 82*a*. The second base portion 75 is a portion of the valve base 71 and disposed between the first proximal end 81*a* and the third proximal end 83*a*.

The injection arrangement area A1 is formed expanding circumferentially larger on the first and the second proximal ends 81*a*, 82*a* side than on the first and the second distal ends 81*b*, 82*b* side. The injection arrangement area A1 is larger than an area A2 that is defined by the first arm 81 and the third arm 83. Because the first arm 81 and the third arm 83 are parallel to each other, the distance between the first distal end 81*b* of the first arm 81 and the third distal end 83*b* of the third arm 83 and the distance between the first proximal end 81*a* of the first arm 81 and the third proximal end 83*a* of the third arm 83 are the same in length. The injection arrangement area A1 is larger than a portion of the area A2 that presents between the first distal end 81*b* and the third distal end 83*b* and a portion of the area A2 between the first proximal end 81*a* and the third proximal end 83*a*.

The injection port 63 may be located in any position within the injection arrangement area A1. The injection port 63 may be located closer to the first and the second proximal ends 81*a*, 82*a* than to the first and the second distal ends 81*b*, 82*b* within the injection arrangement area A1.

As shown in FIG. 4, the first base portion 74 is formed at least partly narrower than the second base portion 75 in the view from the thickness direction of the base plate 31 of the fixed scroll 30. This configuration helps make the injection arrangement area A1 larger than the area A2.

As shown in FIG. 5, the scroll type compressor 10 according to this embodiment includes a retainer 90 for regulating the opening degree of the valve 70. The retainer 90 is formed in a plate shape and thicker than the valve 70. The retainer 90 is fixed to the second surface 31*b* of the base plate 31 of the fixed scroll 30 by the bolts 73 with the valve 70 interposed between the retainer 90 and the second surface 31*b*. The retainer 90 has the same shape as the valve 70 in the view from the thickness direction of the base plate 31 and is disposed over the valve 70. The retainer 90 presses the valve base 71 of the valve 70 against the base plate 31 of the fixed scroll 30 by the tightening force of the bolts 73, but is lifted up partially from the first to the third arms 81 to 83 so as to keep a distance from the first to the third distal ends 81*b* to 83*b* of the first to the third arms 81 to 83. This configuration enables the first to the third distal ends 81*b* to 83*b* to swing between the second surface 31*b* of the base plate 31 and the retainer 90.

According to this configuration, refrigerant in the compression region 50 is discharged through the main discharge port 60, the first sub-discharge port 61, and the second sub-discharge port 62 while pushing away the first to the third distal ends 81*b* to 83*b*. In this case, the retainer 90 regulates the opening degree of the respective distal ends 81*b* to 83*b* from the base plate 31. The valve 70 eliminates or minimizes the back-flow of refrigerant from the discharge chamber 64 to the compression region 50.

According to this embodiment of the present invention, the main discharge, the first sub-discharge, and the second sub-discharge ports 60 to 62 are disposed adjacent to the center of the second surface 31*b* of the fixed scroll 30, and the valve base 71 is disposed radially outward of the outer periphery of the scroll wall 32 of the fixed scroll 30. This configuration enables the first to the third arms 81 to 83 to be formed long enough so as to open the valve 70 by a relatively low pressure.

The retainer 90 may be configured so as to press the valve base 71 only or partly press each of the first to the third arms 81 to 83 in addition to the valve base 71. In the latter case, the parts of the respective first to the third arms 81 to 83 pressed by the retainer 90 may be adjusted so that the swing parts of the respective first to the third arms 81 to 83 are the same in length.

The above embodiment offers the following effects.

(1) The scroll type compressor 10 includes the fixed scroll 30 and the movable scroll 40. The movable scroll 40 cooperates with the fixed scroll 30 to define a compression region 50 and is configured to make an orbital motion to compress refrigerant in the compression region 50. The base plate 31 of the fixed scroll 30 has the main discharge port 60, the first and the second sub-discharge ports 61, 62, and the injection port 63. The main discharge port 60, the first and the second sub-discharge ports 61, 62 and the injection port 63 pass through the base plate 31 and are configured to communicate with the compression region 50. The first and the second sub-discharge ports 61, 62 and the injection port 63 are disposed outward of the main discharge port 60 in the radial direction R with respect to the center of the scroll wall 32 of the fixed scroll 30. The valve 70 is disposed on the second surface 31*b* of the base plate 31 of the fixed scroll 30 and covers the main discharge port 60 and the first and the second sub-discharge ports 61, 62.

According to this configuration, the valve 70 includes the valve base 71. The valve base 71 is disposed outward of the main discharge, the first and the second sub-discharge, and the injection ports 60 to 63 in the radial direction R and extends in the circumferential direction C with respect to the center of the scroll wall 32 of the fixed scroll 30. The valve base 71 has the through holes 72 that serve as the attaching portion. The valve 70 further includes the first and the second arms 81, 82 that respectively extend from the valve base 71 to the main discharge port 60 and the first sub-discharge port 61. Specifically, the first and the second arms 81, 82 respectively extend from the first and the second proximal ends 81*a*, 82*a* on the valve base 71 so as to come closer to each other at the first distal end 81*b* of the first arm 81 and the second distal end 82*b* of the second arm 82 than at the first proximal end 81*a* of the first arm 81 and the second proximal end 82*a* of the second arm 82. The injection port 63 is disposed in the injection arrangement area A1 that is the area between the first arm 81 and the second arm 82 on the second surface 31*b* of the base plate 31 and closer to the first and the second proximal ends 81*a*, 82*a* than to the first and the second distal ends 81*b*, 82*b*.

Because the first arm 81 and the second arm 82 extend from the first and the second proximal ends 81*a*, 82*a* on the valve base 71 so as to come closer to each other at the first distal end 81*b* of the first arm 81 and the second distal end 82*b* of the second arm 82 than at the first proximal end 81*a* of the first arm 81 and the second proximal end 82*a* of the second arm 82, this configuration enables to secure the large injection arrangement area A1 especially, on the first and the second proximal ends 81*a*, 82*a* side, so as to arrange the injection port 63 between the first arm 81 and the second arm 82. Therefore, this configuration enables both of the main discharge port 60 and the first sub-discharge port 61 to be covered by the single valve 70 without the covering of the injection port 63. As a result, this configuration eliminates or minimizes the back-flow of refrigerant through the main discharge port 60 or the first sub-discharge port 61 without the increase of the number of parts of the compressor 10.

(2) According to this embodiment of the present invention, the second arm 82 extends longer than the first arm 81. One of the through holes 72, specifically, the through hole 72 formed through the first end 71*a*, is closer to the second arm 82 than to the first arm 81. Because the second arm 82 is longer than the first arm 81, in general, the second arm 82 is more difficult to be positioned relative to the first sub-discharge port 61 or is more likely to be displaced from the first sub-discharge port 61 than the first arm 81 positioned relative to the main discharge port 60. In this embodiment, the bolt 73 and the through hole 72 are disposed close to the second proximal end 82*a* of the longer second arm 82, so that the second arm 82 is relatively less likely to be displaced from the first sub-discharge port 61.

(3) The valve base 71 is disposed radially outward of the outer periphery of the scroll wall 32 of the fixed scroll 30 in the view from the thickness direction of the base plate 31 of the fixed scroll 30 with respect to the center of the scroll wall 32 of the fixed scroll 30. The base plate 31 of the fixed scroll 30 has the bolt holes 31*c* that are disposed radially outward of the outer periphery of the scroll wall 32 of the fixed scroll 30 with respect to the center of the scroll wall 32 of the fixed scroll 30. The bolt holes 31*c* are configured to communicate with the through holes 72, respectively. The scroll type compressor 10 includes the bolts 73 that are inserted through the through holes 72 and screwed into the bolt holes 31*c*, respectively.

The bolt holes 31*c* are disposed radially outward of the outer periphery of the scroll wall 32 of the fixed scroll 30 with respect to the center of the scroll wall 32 of the fixed scroll 30 in the view from the thickness direction, so that the bolt holes 31*c* are not likely to influence the compression of refrigerant held in the compression region 50. Accordingly, this configuration eliminates or minimizes troubles in compression of refrigerant, which may be caused by the configuration for fixing the valve 70 to the second surface 31*b* of the base plate 31 of the fixed scroll 30.

The valve base 71 is radially outward of the outer periphery of the scroll wall 32 of the fixed scroll 30 with respect to the center of the scroll wall 32 of the fixed scroll 30. This configuration enables the first arm 81 and the second arm 82 to be formed long enough so as to open the valve 70 by a relatively low pressure.

(4) The base plate 31 of the fixed scroll 30 has therethrough the second sub-discharge port 62 other than the first sub-discharge port 61. The second sub-discharge port 62 is disposed across the main discharge port 60 from the first sub-discharge port 61. The valve 70 includes the third arm 83 that extends from the valve base 71 to the second sub-discharge port 62. The third arm 83 is disposed across the first arm 81 from the second arm 82. The injection arrangement area A1 between the first arm 81 and the second arm 82 is larger than the area A2 between the first arm 81 and the third arm 83. This configuration enables the main discharge port 60 and the first and the second sub-discharge ports 61, 62 to be covered by the single valve 70 while enabling the injection arrangement area A1 to be formed larger than the area A2.

The third arm 83 is disposed across the first arm 81 from the second arm 82 as the second sub-discharge port 62 is disposed across the main discharge port 60 from the first sub-discharge port 61. This configuration enables the third arm 83 to cover the second sub-discharge port 62 without interfering with the first arm 81 or the second arm 82 or entering the injection arrangement area A1.

(5) The first base portion 74 is circumferentially longer than the second base portion 75. This configuration enables the injection arrangement area A1 to be formed largely for more suitable arrangement of the injection port 63 in the injection arrangement area A1.

The present embodiment may be modified variously as exemplified below.

Figure 6:
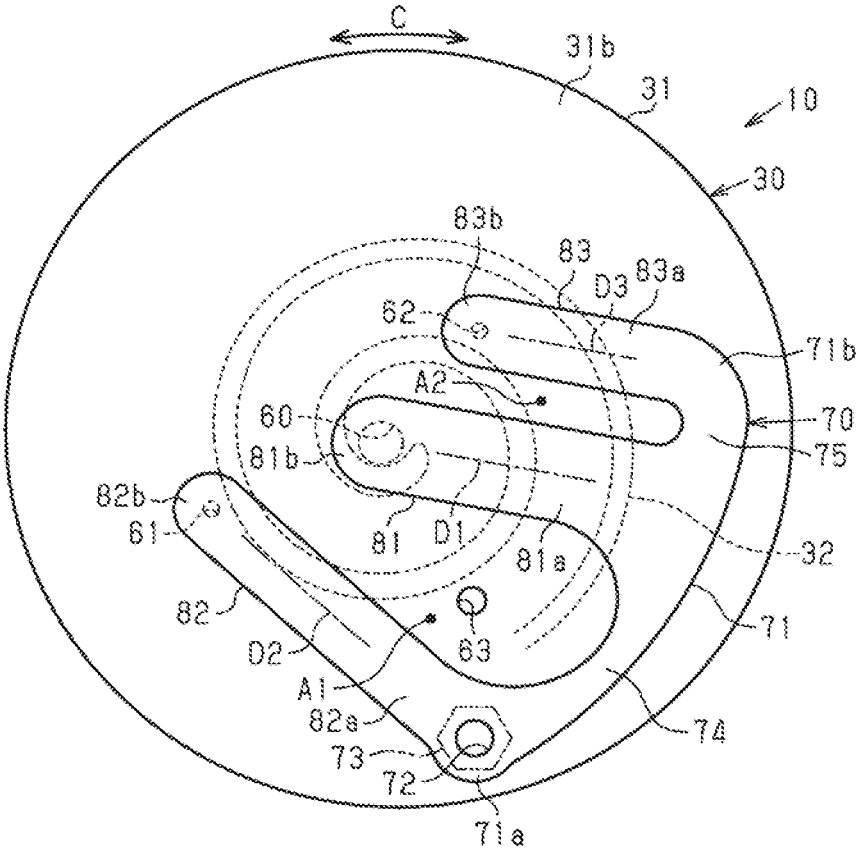
FIG. 6 is a front view of a valve according to modification of the present invention.

As shown in FIG. 6, the attaching portion of the valve base 71 for fixing the valve 70 to the second surface 31*b* may be formed by the single through hole 72. Specifically, the through hole 72 may be removed from the second end 71*b* of the valve base 71. In this case, the bolt 73 and the bolt hole 31*c* that are associated with the removed through hole 72 may be also removed. The attaching portion may be disposed at any position other than at the first and the second ends 71*a*, 71*b* of the valve base 71. The attaching portion of the valve base 71 for fixing the valve 70 to the second surface 31*b* is preferably disposed closer to the first arm 81 or the second arm 82, whichever extends longer than the other. This configuration eliminates or minimizes the displacement of the longer arm, which is more likely to be displaced than the other arm.

The lengths of the respective first to the third arms 81 to 83 may be determined as necessary. For example, the first to the third arms 81 to 83 may be the same in length.

The valve base 71 may be disposed at any position. For example, the valve base 71 may be disposed adjacent to the center of the second surface 31*b* of the base plate 31 so as to be at least partly located inward of the outer periphery of the scroll wall 32 of the fixed scroll 30. However, for securing substantial lengths of the respective first to the third arms 81 to 83, it is preferable to dispose the valve base 71 on the outer periphery region of the second surface 31*b* of the base plate 31.

Any number of the sub-discharge ports, such as one port or at least three ports, may be provided. For example, the second sub-discharge port 62 may be removed. In this case, it is desirable to remove the third arm 83.

The base plate 31 of the fixed scroll 30 may have on the second surface 31*b* thereof a plate that has therethrough holes communicating with the main discharge port 60, the first and the sub-discharge ports 61, 62, and the injection ports 63, respectively. In this case, it is preferable to dispose the valve 70 on the plate that is fixed to the second surface 31*b* of the base plate 31 of the fixed scroll 30. In this configuration, the plate serves as a part of the base plate 31, and the surface of the plate facing away from the base plate 31 serves as the second surface of the base plate 31.

The configuration of the attaching portion of the valve base 71 for fixing the valve 70 to the second surface 31*b* of the base plate 31 is not limited to the configuration according to the above embodiment.

The first and the second sub-discharge ports 61, 62 and the injection port 63 may be disposed at any position. For example, at least one of the first and the sub-discharge ports 61, 62 may be disposed inward of the outer periphery of the scroll wall 32.

The injection port 63 may be disposed at any position within the area between the first arm 81 and the second arm 82 in which the distance between the first arm 81 and the second arm 82 is larger on the first and the second proximal ends 81*a*, 82*a* side than on the first and the second distal ends 81*b*, 82*b* side.

Fluid to be compressed by the scroll type compressor 10 is not limited to refrigerant, and any suitable fluid may be selected as necessary.

If two injection ports 63, namely the first and the second injection ports, are provided, both of the first and the second injection ports 63 may be arranged in the injection arrangement area A1 between the first arm 81 and the second arm 82, or the first and the second injection ports 63 may be respectively arranged in the injection arrangement area A1 and in the area A2 between the first arm 81 and the third arm 83. In this case, the extending directions D1 and D3 may intersect one another so that the area A2 is formed larger on the first and the third proximal ends 81*a*, 83*a* side than on the first and the third distal ends 81*b*, 83*b* side as well as the injection arrangement area A1. The second injection port 63 may be disposed in any area on the second surface 31*b* of the base plate 31 other than the injection arrangement area A1 and the area A2.

The aforementioned embodiment of the present invention may appropriately be combined with the aforementioned modifications.

What is claimed is:

1. A scroll compressor comprising:

a fixed scroll including a base plate and a scroll wall, the base plate including first and second surfaces on opposite sides of the base plate, the scroll wall extending from the first surface of the base plate; and a movable scroll including a base plate and a scroll wall, the base plate of the movable scroll facing the base plate of the fixed scroll, the scroll wall of the movable scroll extending from the base plate of the movable scroll toward the base plate of the fixed scroll to mesh with the scroll wall of the fixed scroll, the movable scroll cooperating with the fixed scroll to define a compression region and being configured to make an orbital motion to compress fluid in the compression region, wherein the base plate of the fixed scroll has therethrough a main discharge port, a sub-discharge port, and an injection port that are configured to communicate with the compression region, a portion of the compression region with which the sub-discharge port communicates is larger than a portion of the compression region with which the main discharge port communicates, a portion of the compression region with which the injection port communicates to supply fluid to the compression region is larger than the portion of the compression region with which the main discharge port communicates, the base plate of the fixed scroll further has on the second surface thereof a valve that covers the main discharge port and the sub-discharge port, the valve includes a valve base, a first arm, and a second arm, the movable scroll is connected to a rotary shaft through a bush and a bearing, the valve base is disposed radially outward of the main discharge port, the sub-discharge port, and the injection port with respect to the rotary shaft and extending circumferentially with respect to the rotary shaft, and includes an attaching portion to fix the valve to the second surface of the base plate of the fixed scroll, the first arm includes proximal and distal ends and extends from the proximal end that is disposed on the valve base to the main discharge port, the second arm includes proximal and distal ends and extends from the proximal end that is disposed on the valve base to the sub-discharge port, the first arm and the second arm extend so as to come closer to each other at the distal end of the first arm and the distal end of the second arm than at the proximal end of the first arm and the proximal end of the second arm, the injection port is disposed in an injection arrangement area on the second surface of the base plate of the fixed scroll, and the injection arrangement area is an area that is located between the first arm and the second arm and expands larger on the proximal ends side of the first and the second arms than on the distal ends side of the first and the second arms.

2. The scroll compressor according to claim 1, wherein the attaching portion is disposed closer to the first arm or the second arm, whichever extends longer than the other.

3. The scroll type-compressor according to claim 2, wherein the second arm extends longer than the first arm, and the attaching portion is disposed closer to the second arm than to the first arm.

4. The scroll type-compressor according to claim 1, wherein the sub-discharge port is a first sub-discharge port, the base plate of the fixed scroll has therethrough a second sub-discharge port, the second sub-discharge port is disposed across the main discharge port from the first sub-discharge port, the valve includes a third arm that extends from the valve base to the second sub-discharge port and is disposed on an opposite side of the second arm across the first arm, and the injection arrangement area is larger than an area between the first arm and the third arm.

5. The scroll type-compressor according to claim 1, wherein the attaching portion is formed by a through hole, the valve base is disposed radially outward of an outer periphery of the scroll wall of the fixed scroll with respect to the rotary shaft, the base plate of the fixed scroll has therein a bolt hole that is disposed radially outward of the outer periphery of the scroll wall of the fixed scroll with respect to the rotary shaft, and the scroll type compressor further includes a bolt that is inserted through the through hole and screwed into the bolt hole.

6. The scroll type-compressor according to claim 4, wherein the valve base includes a first base portion and a second base portion, the first base portion is a portion of the valve base between the first arm and the second arm, the second base portion is a portion of the valve base between the first arm and the third arm, and the first base portion extends circumferentially longer than the second base portion.

* * * * *